US011969064B2

(12) United States Patent
Dotterweich

(10) Patent No.: US 11,969,064 B2
(45) Date of Patent: Apr. 30, 2024

(54) UMBRELLA WITH DUAL ARMS TO TIGHTEN AND TOP FABRIC FOR CLEAN LOOK AND ABILITY TO BRAND

(71) Applicant: Martin James Dotterweich, Escondido, CA (US)

(72) Inventor: Martin James Dotterweich, Escondido, CA (US)

( * ) Notice: Subject to any disclaimer, the term of this patent is extended or adjusted under 35 U.S.C. 154(b) by 21 days.

(21) Appl. No.: 17/580,438

(22) Filed: Jan. 20, 2022

(65) Prior Publication Data

US 2022/0248817 A1 Aug. 11, 2022

Related U.S. Application Data

(60) Provisional application No. 63/140,139, filed on Jan. 21, 2021.

(51) Int. Cl.
*A45B 25/02* (2006.01)

(52) U.S. Cl.
CPC ..... *A45B 25/02* (2013.01)

(58) Field of Classification Search
CPC ..... A45B 19/10; A45B 25/02; A45B 25/22; E04H 15/28
USPC ..... 135/27, 25.33, 25.32
See application file for complete search history.

(56) References Cited

U.S. PATENT DOCUMENTS

| | | | | | |
|---|---|---|---|---|---|
| 364,987 | A * | 6/1887 | Burnett | A45B 25/22 | 135/30 |
| 744,476 | A * | 11/1903 | Burgess | A45B 19/10 | 135/25.4 |
| 778,940 | A * | 1/1905 | Allen | A45B 19/10 | 135/25.4 |
| 831,381 | A * | 9/1906 | Sawaya | A45B 19/10 | 135/25.33 |
| 1,036,142 | A * | 8/1912 | Parker | A45B 19/10 | 135/25.33 |
| 1,397,794 | A * | 11/1921 | Romeyn | A45B 25/22 | 135/31 |
| 1,628,539 | A * | 5/1927 | Grey | A45B 25/00 | 135/15.1 |
| 1,908,453 | A * | 5/1933 | Schmidt | A45B 19/10 | 135/22 |
| 3,853,135 | A * | 12/1974 | Schafer | A45B 19/10 | 135/25.4 |

FOREIGN PATENT DOCUMENTS

| | | | | |
|---|---|---|---|---|
| WO | WO-2008114305 A2 * | 9/2008 | ..... | A45B 19/12 |

* cited by examiner

*Primary Examiner* — Noah Chandler Hawk
(74) *Attorney, Agent, or Firm* — Buche & Associates, P.C.; John Buche; Bryce Johnson

(57) ABSTRACT

Disclosed is an umbrella with dual arms to tighten a fabric or sheet material cover for a clean look and ability to brand. With the dual arms, or spokes, the framework can be created that is solid while operating in the manner of a traditional umbrella.

3 Claims, 9 Drawing Sheets

UMBRELLA WITH DUAL ARMS TO TIGHTEN AND TOP FABRIC FOR CLEAN LOOK AND ABILITY TO BRAND

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The subject matter of this disclosure is in the field of umbrellas or parasols.

Background of the Invention

An umbrella (rain shield) or parasol (sun shade) is a foldable canopy defined by a fabric-covered, hub-and-spoke frame coaxially situated at the top of a pole. FIG. 1 shows a traditional umbrella (1000) or parasol with a hub-and-spoke frame (1100). See U.S. Des. Pat. No. D652,615 (issued Jan. 12, 2012) to Paolucci. As shown in FIG. 1, in a popped-up configuration, the foldable spokes (1110) of the hub-and-spoke frame (1100) radiate from the top of the central pole (1200) so that the fabric-cover (1300) is stretched taut over the spokes (1110) to form a valanced canopy above the central pole (1200). In a collapsed configuration (not shown), the spokes (1110) are folded downward to the pole (1200) while the fabric cover (1300) slacks so that the cover can be wrapped closely around the spokes (1110) and central pole (1200).

Still referring to FIG. 1, the fabric cover (1300) is sewn onto the spokes (1100) so that the fabric (1300) will (a) fit tightly over the popped-up hub-and-spoke (1100) frame and b) slack to a flat and folded state over the collapsed hub-and-spoke frame (1100) and pole (1200). Suitably, the with fabric cover (1300) is provided with valances (1310) that are hemmed vertically at each end of the spoke (1110) so that the valances (1200) drape downward to screen the umbrella/parasol and the space beneath it. Typically, the valances (1310) are slack so that they umbrella/parasol may collapse properly.

The traditional umbrella frame and cover is not suitable for all situations. In most cases, for example, the umbrella/parasol spokes are often flimsy and the flimsiness causes the hub and spoke frame to be easily turned inside out when caught in the wind. Additionally, the cover's valances are slack and, as a result, flap in the wind which can make undesirable noise and can cause emblems or branding positioned on the valances to be obscured. So, there is a need for umbrellas/parasols that have sturdier frames and covers that have valances that can maintain their configuration.

SUMMARY OF THE INVENTION

In view of the foregoing, an object of this specification is to disclose an umbrella/parasol frame with a cover that is sturdy and features valances that do not flap in the wind while folding in the traditional way. It is a further objective of this specification to disclose an umbrella or parasol with an improved look and appearance where the fabric cover is pulled taut over a solid framework that functions as a traditional umbrella or parasol frame. Suitably, the fabric creates a solid, "wrap around" look to the canopy and creates a tight fit so that the valance of the canopy are restricted from flapping in the wind.

In a preferred embodiment, the disclosed canopy frame maybe defined by a center pole with a top hub and a first set of spokes positioned at the top of the center pole, a bottom hub with a second set of spokes positioned at a midpoint of the center pole below the top hub, a first set of risers that connects the first set of spokes to the second set of spokes via the tips of each spoke, a second set of risers that connects the first set of spokes to the second set of spokes at a midpoint of the spokes, and a riser with ribs pivotably connected to a mid point of the spokes.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which:

FIG. 8 is the improved umbrella or parasol frame embodied for use in a cantilever style umbrella system, e.g., where the center pole of the umbrella frame is hung up under a cantilever rather than posted on top of an upright; and, FIG. 9 is another perspective view of the improved umbrella.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PROFFERED EMBODIMENTS

Figure 1:
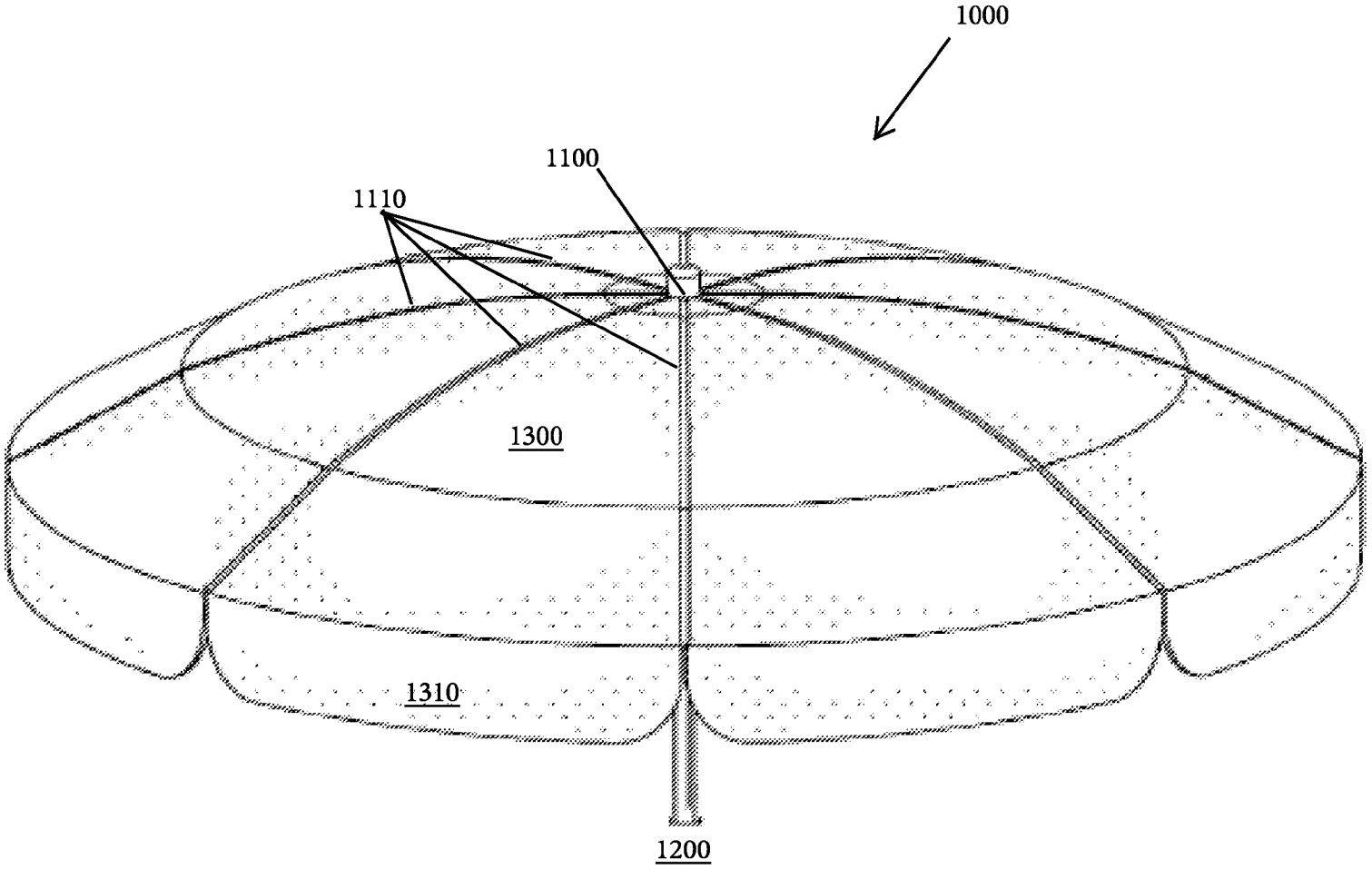
FIG. 1 is a traditional umbrella or Parasol.
Figure 2:
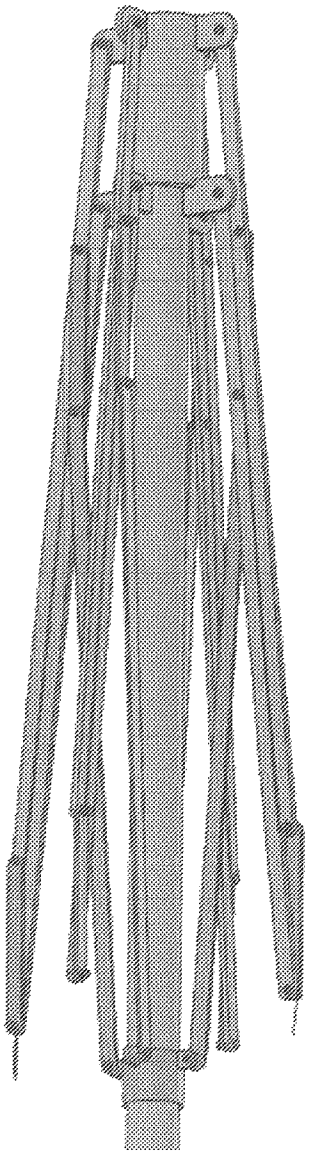
FIG. 2 is an improved umbrella or parasol frame depicted in a collapsed configuration.
Figure 3:
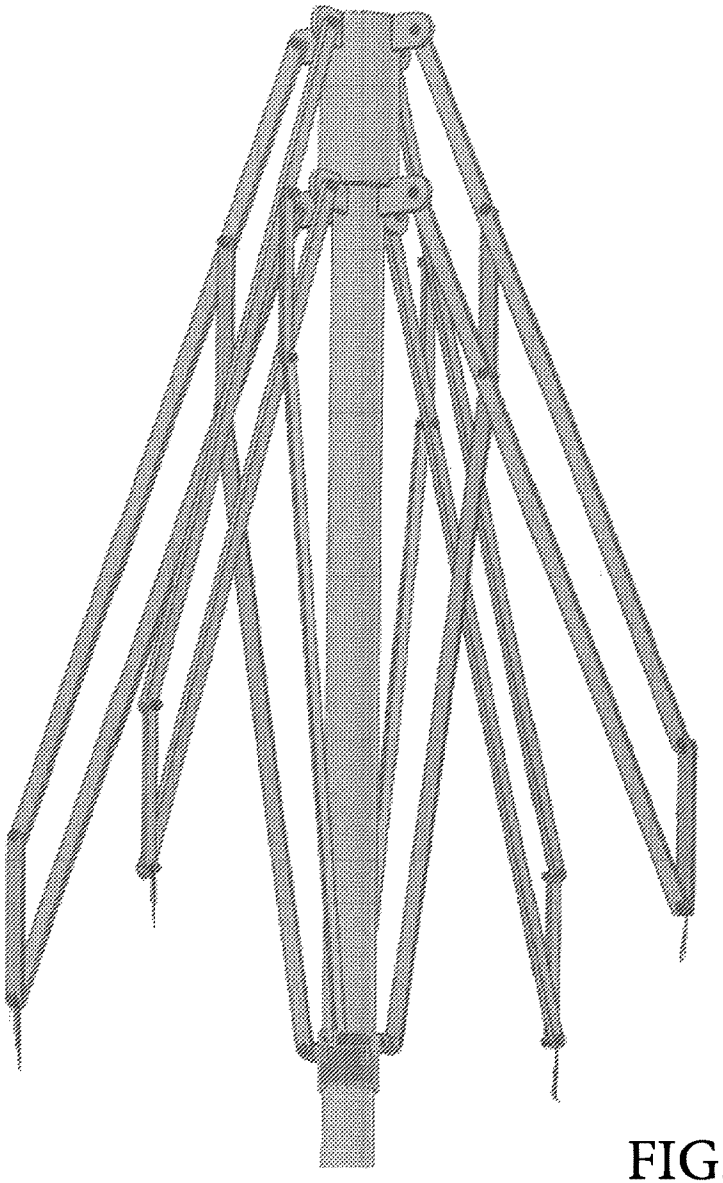
FIG. 3 is the improved umbrella or parasol frame depicted in a partially collapsed configuration.
Figure 4:
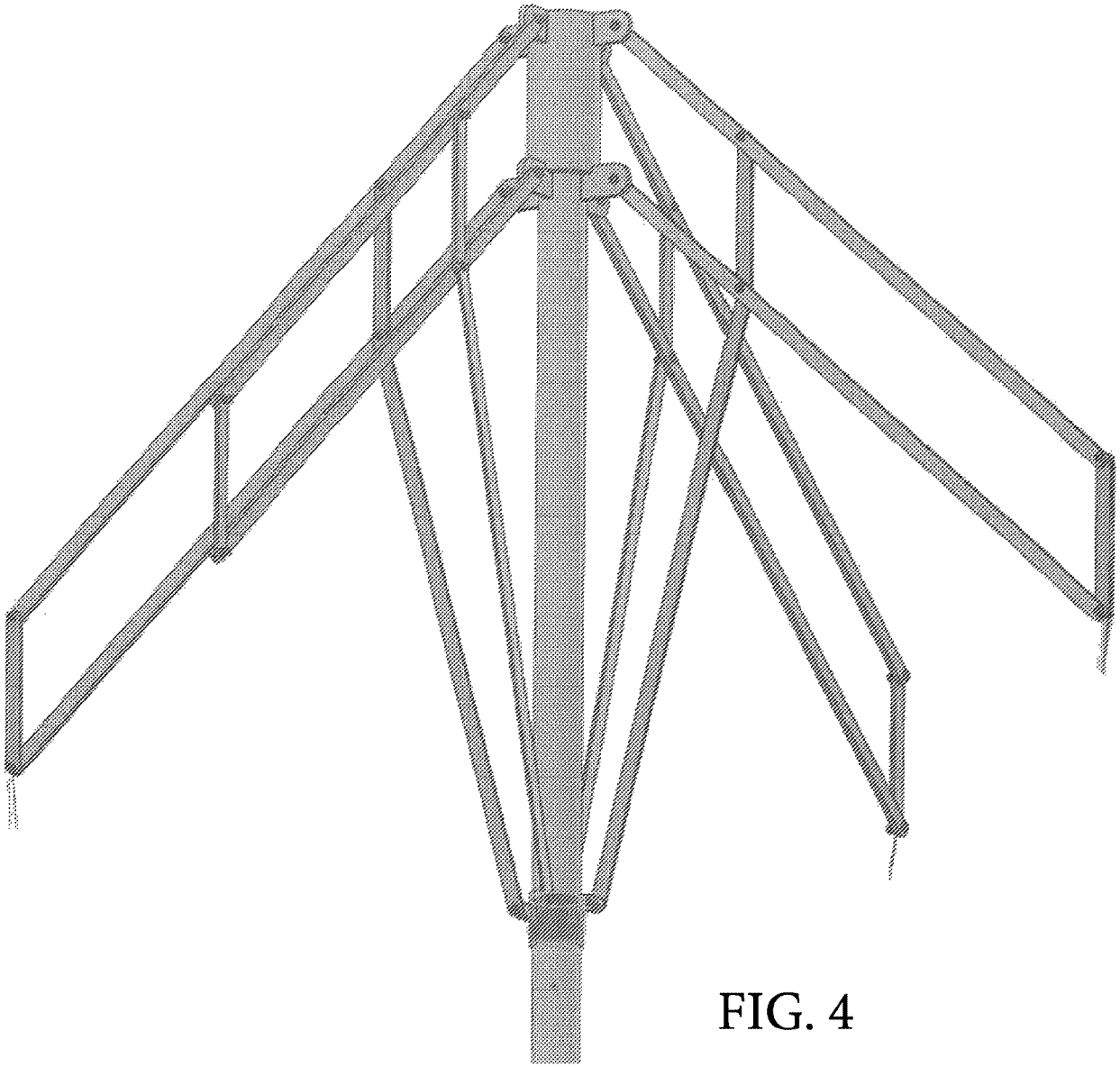
FIG. 4 is the improved umbrella or parasol frame depicted in a partially popped-up configuration.
Figure 5:
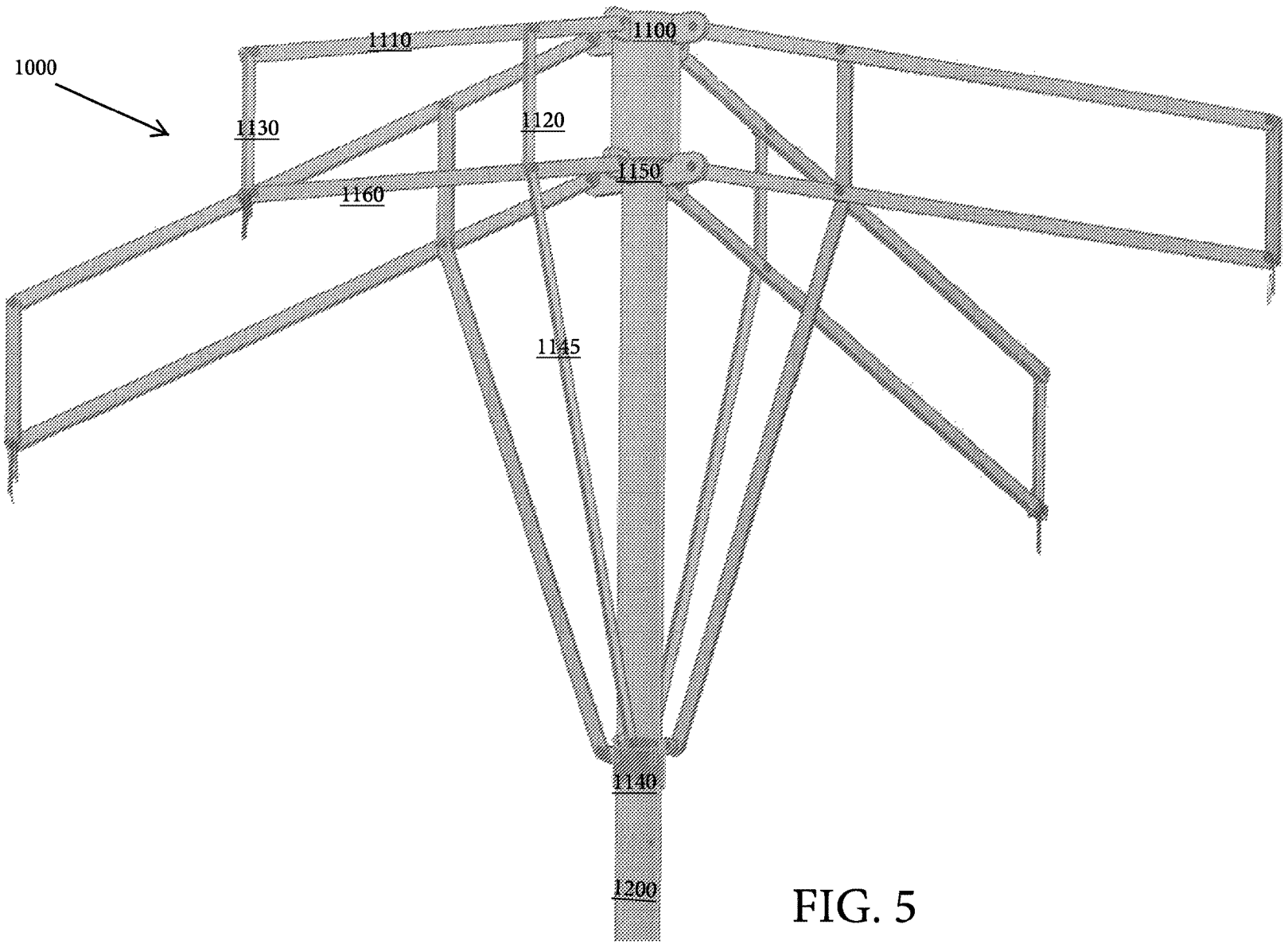
FIG. 5 is the improved umbrella or parasol frame depicted in a popped-up configuration.
Figure 6:
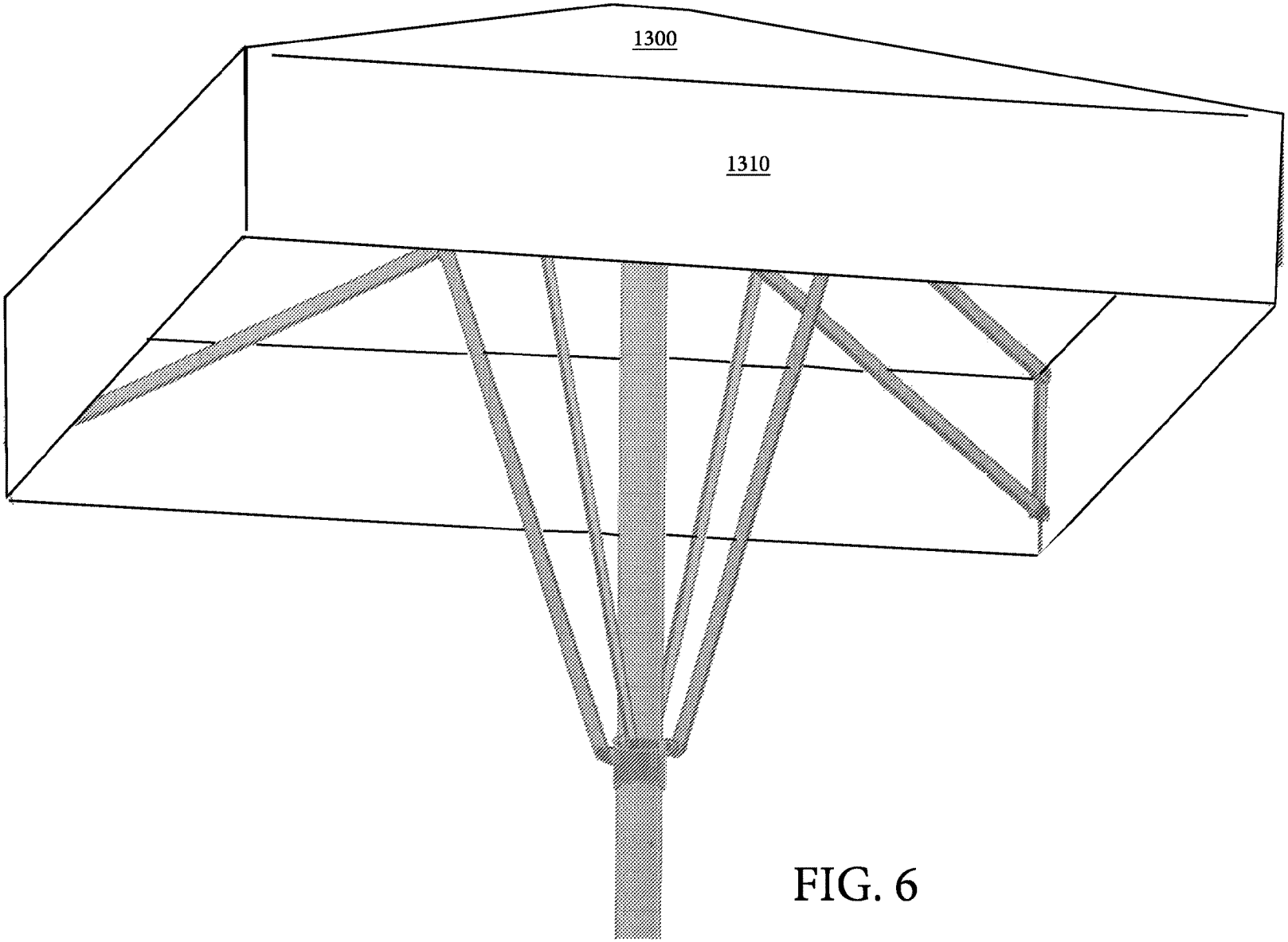
FIG. 6 is the improved umbrella or parasol frame depicted in a popped-up configuration with a fabric cover.
Figure 7:
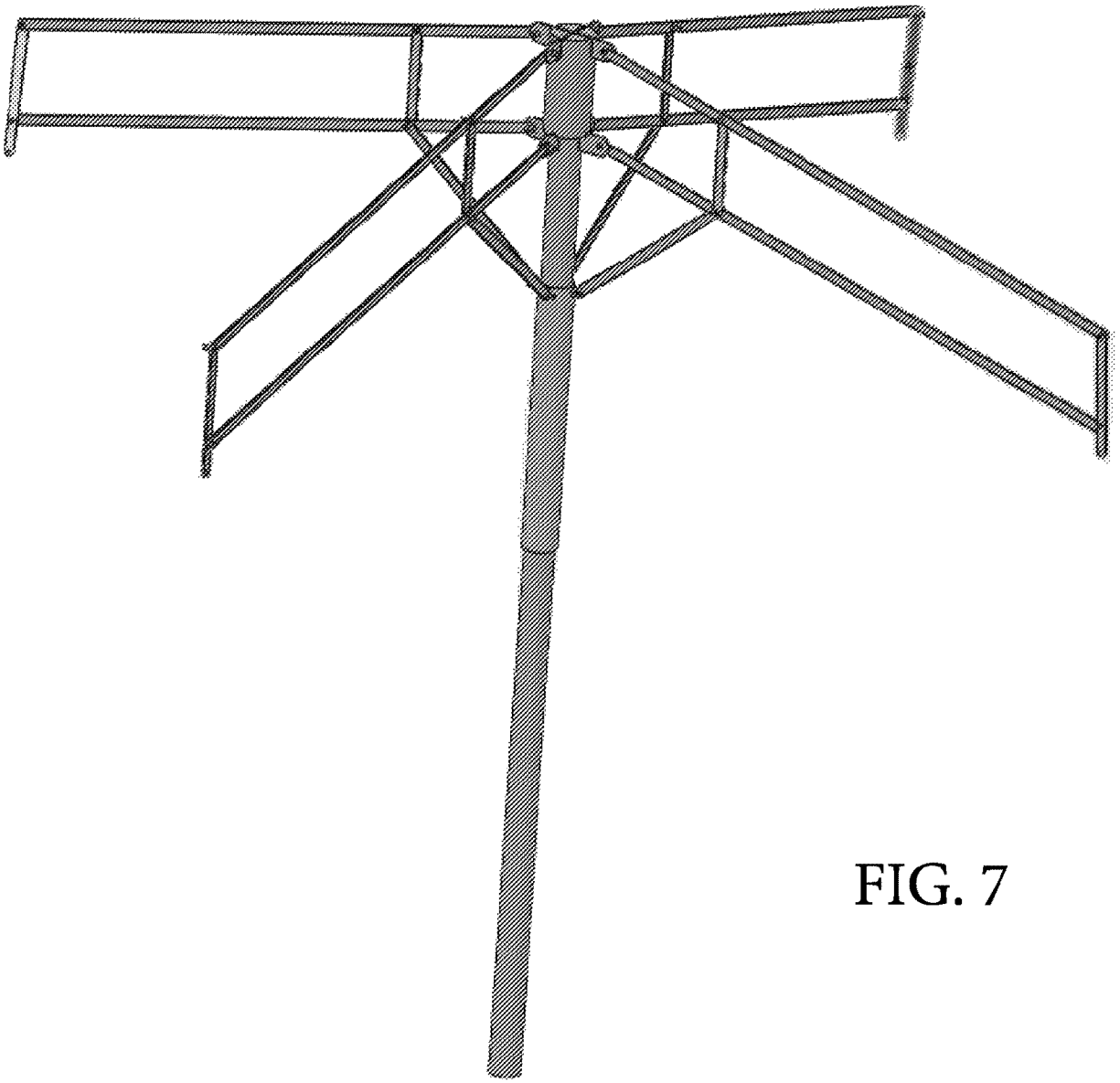
FIG. 7 is the improved umbrella or parasol frame depicted in a popped up configuration and featuring an enlarged or extended riser.
Figure 8:
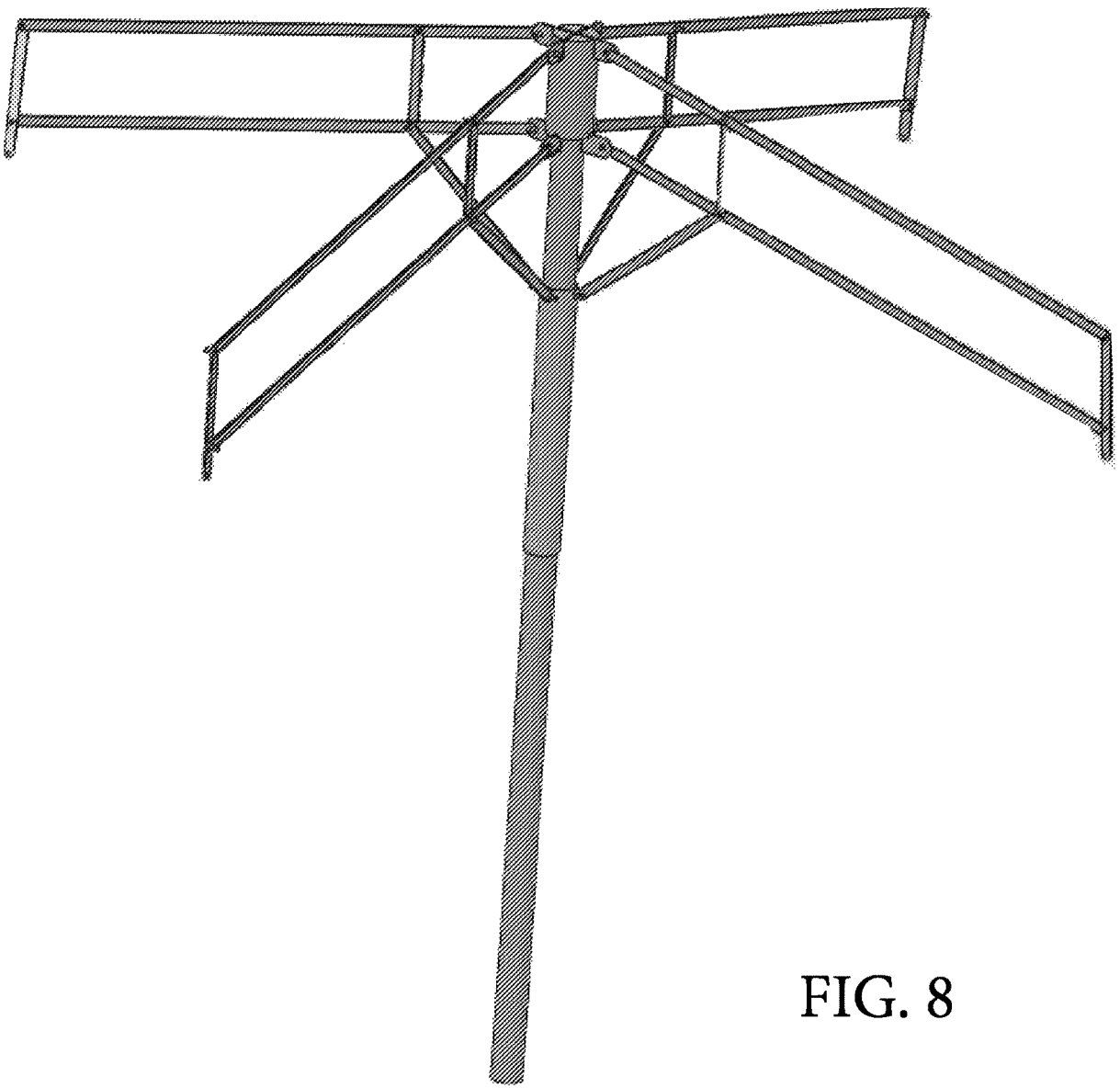
FIG. 8 is the improved umbrella or parasol frame depicted in a popped up configuration and featuring an enlarged or extended riser.
Figure 9:
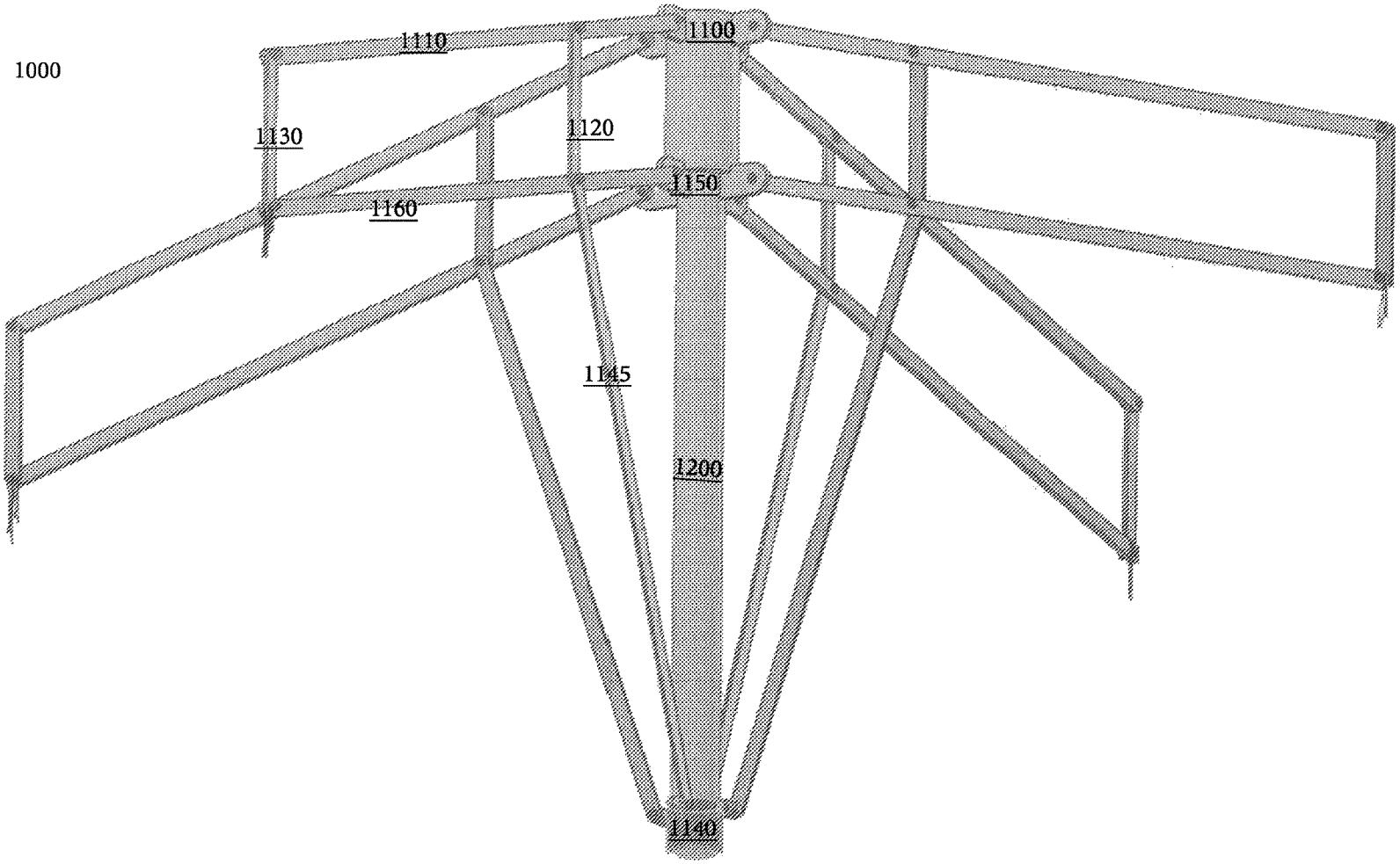

Disclosed is an umbrella or parasol with a framework that operates as a traditional umbrella frame. The details of the improved umbrella or parasol are shown in FIGS. 2 through 6 via depiction of a preferred embodiment. As shown, the depicted framework 1000 includes a first set of spokes (1110) and a second set of spokes (1160) that are connected by a first and second set of risers (1120;1130) so that the first and second set of spokes (1110;1160) move in unison to pop-up or collapse the umbrella's canopy (1300). In the preferred embodiment, the disclosed canopy frame (1000) maybe defined by a center pole (1200) with a top hub (1100) and a first set of spokes (1110) pivotally positioned at the top of the center pole (1200), a bottom hub (1150) with a second set of spokes (1160) pivotally positioned at a midpoint of the center pole (1200) below the top hub (1100). Suitably, each spoke of the first set of spokes (1110) is connected to a corresponding spoke in the second set of spokes (1160) via a first riser (1120) that is pivotally connected to the first and second spokes at a midpoint of each spoke and a second riser (1130) that is pivotally connected to the first and second spokes at a distal end of each spoke. Preferably, a slidable riser (1140) that movies upward or downward along the center pole (1200) is provided with a set of pivotal lifts (1145) for raising or lowering the first and second set of spokes (1110;1160). In one embodiment, the slidable riser (1140) is fit with a locking mechanism to hold the canopy upright when popped. Suitably, a fabric or other sheet-material cover (1300) may be positioned taught over the first set of spokes to form a canopy and folded downward along the second set of risers to form a valance (1310) between each spoke.

In use, the umbrella may be popped-up to create a canopy that can include branding or other messaging on the valance. Ideally, the valance of the are pulled tight or taught and provide space for logos, messages, or icons. The ability to avoid valance wind flap In some cases, LED lights could suitably be added to the first or second set of spokes to create an attractive appearance at nighttime. Attachments, such as those disclosed in U.S. patent Ser. No. 11/072,942 (issued Jul. 27, 2021) to Dotterweich, could be used to support accessories that may be desirably secured to the framework.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. An umbrella or parasol framework (1000) comprising:

a center pole (1200) with a top hub (1100) and a first set of straight spokes (1110) pivotally positioned at the top of the center pole (1200), a bottom hub (1150) with a second set of straight spokes (1160) pivotally positioned at a midpoint of the center pole (1200) below the top hub (1100);

wherein, each spoke of the first set of spokes (1110) is connected to a corresponding spoke in the second set of spokes (1160) via a first set of risers (1120) where each riser of the first set of risers is pivotally connected to a midpoint of one spoke in the first set of spokes and one spoke in the second set of spokes and a second set of risers (1130) is pivotally connected to a tip of one spoke in the first set of spokes and one spoke in the second set of spokes;

a slidable riser (1140) that movies upward or downward along the center pole (1200) wherein the riser (1140) includes with a set of pivotal lifts (1145) for raising or lowering the first and second set of spokes (1110;1160);

wherein the slidable riser (1140) is fit with a locking mechanism that holds the first and second set of spokes (1110;1160) upright in a popped configuration; and, a fabric or other sheet-material cover (1300) that is positioned taught over the first set of spokes (1110) to form a canopy and that is folded downward along the second set of risers to form a valance (1310) between each spoke such that each valance (1310) is pulled tight or taught and upright against (i) a tip of a first one of said spokes in the first set of spokes (1110), (ii) a tip of a first one of said spokes in the second set of spokes (1160), (iii) a tip of a second one of said spokes in the first set of spokes (1110), (iv) a tip of a second one of said spokes in the second set of spokes (1160), (v) a first one of the second set of risers attached to the tip of said first one of said spokes in the first set of spokes (1110) and the tip of a first one of said spokes in the second set of spokes (1160), and (vi) a second one of the second set of risers attached to the tip of said second one of said first set of spokes (1110) and a second one of the second set of said second set of spokes 1160):

whereby the valance is restricted from flapping in the wind and provides space for logos messages or icons.

2. An umbrella or parasol framework (1000) comprising:

a center pole (1200) with a top hub (1100) and a first set of straight spokes (1110) pivotally positioned at the top of the center pole (1200), a bottom hub (1150) with a second set of straight spokes (1160) pivotally positioned at a midpoint of the center pole (1200) below the top hub (1100);

wherein, each spoke of the first set of spokes (1110) is connected to a corresponding spoke in the second set of spokes (1160) via a first set of risers (1120) where each riser of the first set of risers is pivotally connected to a midpoint of one spoke in the first set of spokes and one spoke in the second set of spokes and a second set of risers (1130) that is pivotally connected to a tip of one spoke in the first set of spokes and one spoke in the second set of spokes;

a slidable riser (1140) that movies upward or downward along the center pole (1200) wherein the riser (1140) includes with a set of pivotal lifts (1145) for raising or lowering the first and second set of spokes (1110;1160);

wherein the slidable riser (1140) is fit with a locking mechanism to that holds the first and second set of spokes (1110;1160) upright in a popped configuration; and, a space is created for a valance (1310) between each spoke such that each valance (1310) is defined within (i) a tip of a first one of said spokes in the first set of spokes (1110), (ii) a tip of a first one of said spokes in the second set of spokes (1160), (iii) a tip of a second one of said spokes in the first set of spokes (1110), (iv) a tip of a second one of said spokes in the second set of spokes (1160), (v) a first one of the second set of risers attached to the tip of said first one of said spokes in the first set of spokes (1110) and the tip of a first one of said spokes in the second set of spokes (1160), and (vi) a second one of the second set of risers attached to the tip of said second one of said first set of spokes (1110) and a second one of the second set of said second set of spokes (1160).

3. A method of advertising using an umbrella or parasol framework (1000) and cover (1300) comprising:

popping an umbrella or parasol framework (1000) comprising;

a center pole (1200) with a top hub (1100) and a first set of straight spokes (1110) pivotally positioned at the top of the center pole (1200), a bottom hub (1150) with a second set of straight spokes (1160) pivotally positioned at a midpoint of the center pole (1200) below the top hub (1100);

wherein, each spoke of the first set of spokes (1110) is connected to a corresponding spoke in the second set of spokes (1160) via a first set of risers (1120) where each riser of the first set of risers is pivotally connected to a midpoint of one spoke in the first set of spokes and one spoke in the second set of spokes and a second set of risers (1130) is pivotally connected to a tip of one spoke in the first set of spokes and one spoke in the second set of spokes;

a slidable riser (1140) that movies upward or downward along the center pole (1200) wherein the riser (1140) includes with a set of pivotal lifts (1145) for raising or lowering the first and second set of spokes (1110;1160);

wherein the slidable riser (1140) is fit with a locking mechanism to that holds the first and second set of spokes (1110;1160) upright in a popped configuration; and, ensuring the valance is restricted from flapping in the wind via placing a fabric or other sheet-material cover (1300) that is positioned taught over the first set of spokes (1110) to form a canopy and that is folded downward along the second set of risers to form a valance (1310) between each spoke such that each valance (1310) is pulled fight or taught and upright against (i) a tip of a first one of said spokes in the first set of spokes (1110), (ii) a tip of a first one of said spokes in the second set of spokes (1160), (iii) a tip of a second one of said spokes in the first set of spokes (1110), (iv) a tip of a second one of said spokes in the second set of spokes (1160), (v) a first one of the second set of risers attached to the tip of said first one of said spokes in the first set of spokes (1110) and the tip of a first one of said spokes in the second set of spokes (1160), and (vi) a second one of the second set of risers attached to the tip of said second one of said first set of spokes (1110) and a second one of the second set of said second set of spokes (1160); and, placing a logo, message or icons on the valance.

* * * * *